US010442654B2

(12) United States Patent
Yamamoto

(10) Patent No.: US 10,442,654 B2
(45) Date of Patent: Oct. 15, 2019

(54) SHEET PROCESSING APPARATUS AND SHEET DISCHARGE METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Mikio Yamamoto, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/147,919

(22) Filed: Oct. 1, 2018

(65) Prior Publication Data

US 2019/0031463 A1 Jan. 31, 2019

Related U.S. Application Data

(63) Continuation of application No. 15/438,980, filed on Feb. 22, 2017, now Pat. No. 10,099,886.

(51) Int. Cl.
*B65H 29/58* (2006.01)
*B65H 43/00* (2006.01)
(Continued)

(52) U.S. Cl.
CPC ..... *B65H 43/00* (2013.01); *B65H 29/34* (2013.01); *B65H 29/52* (2013.01); *B65H 31/02* (2013.01); *B65H 31/08* (2013.01); *B65H 31/24* (2013.01); *B65H 31/26* (2013.01); *B65H 31/3018* (2013.01); *B65H 31/3081* (2013.01); *G03G 15/6529* (2013.01); *G03G 15/6538* (2013.01); *B65H 2301/4212* (2013.01);
(Continued)

(58) Field of Classification Search
CPC ..... B42C 1/12; B65H 43/00; B65H 31/08; B65H 31/26; B65H 31/3081; B65H 29/26; B65H 29/58; B65H 2301/4223; B65H 2301/42264; B65H 2301/42261; B65H 2801/27; G03G 15/6529
USPC ..... 270/58.14, 58.15, 58.18, 58.19, 58.28; 271/303
See application file for complete search history.

(56) References Cited

U.S. PATENT DOCUMENTS 6,290,220 B1 9/2001 Takehara et al.
6,942,206 B2 9/2005 Kuwata et al.
(Continued)

OTHER PUBLICATIONS

Non-Final Office Action for U.S. Appl. No. 15/438,980 dated Feb. 9, 2018.

*Primary Examiner* — Leslie A Nicholson, III
(74) *Attorney, Agent, or Firm* — Amin, Turocy & Watson LLP

(57) ABSTRACT

In accordance with an embodiment, a sheet processing apparatus comprises a first tray, a second tray, a third tray, a lower supporting plate, a drive section and a control device. The second tray is located at the lower part of the first tray. The third tray is located at a downstream side with respect to the second tray in a sheet conveyance direction. The lower supporting plate can support the sheet from the lower part. The drive section drives the lower supporting plate. The control device controls the drive section to arrange the lower supporting plate at the downstream side with respect to a conveyance starting point of the sheet in the sheet conveyance direction in a case of skipping the first tray and the second tray to convey the sheet to the third tray.

19 Claims, 10 Drawing Sheets

(51) Int. Cl.

| | |
|---|---|
| ***G03G 15/00*** | (2006.01) |
| ***B65H 29/34*** | (2006.01) |
| ***B65H 29/52*** | (2006.01) |
| ***B65H 31/02*** | (2006.01) |
| ***B65H 31/24*** | (2006.01) |
| ***B65H 31/26*** | (2006.01) |
| ***B65H 31/30*** | (2006.01) |
| ***B65H 31/08*** | (2006.01) |

(52) U.S. Cl.

CPC .. *B65H 2301/4213* (2013.01); *B65H 2404/61* (2013.01); *B65H 2404/68* (2013.01); *B65H 2404/693* (2013.01); *B65H 2405/11151* (2013.01); *B65H 2405/332* (2013.01); *B65H 2405/3311* (2013.01); *B65H 2801/27* (2013.01)

(56) References Cited

U.S. PATENT DOCUMENTS

| | | | |
|---|---|---|---|
| 7,134,655 | B2 | 11/2006 | Terao et al. |
| 7,150,452 | B2 | 12/2006 | Terao et al. |
| 7,172,187 | B2 | 2/2007 | Terao et al. |
| 2009/0166946 | A1 | 7/2009 | Iguchi et al. |

SHEET PROCESSING APPARATUS AND SHEET DISCHARGE METHOD

CROSS-REFERENCE TO RELATED APPLICATION

This application is a Continuation of application Ser. No. 15/438,980 filed on Feb. 22, 2017, the entire contents of which are incorporated herein by reference.

FIELD

Embodiments described herein relate generally to a sheet processing apparatus and a sheet discharge method.

BACKGROUND

Conventionally, there is a post-processing apparatus for carrying out a post-processing on a sheet conveyed from an image forming apparatus. The post-processing apparatus is equipped with a processing tray, a standby tray and a discharge tray. The processing tray carries out the post-processing. The standby tray is arranged at the upper part of the processing tray. The standby tray temporarily buffers succeeding sheets while the post-processing of a sheet is carried out by the processing tray. The standby tray drops a buffered sheet towards the processing tray if the processing tray is in a standby state. The discharge tray is arranged at a downstream side with respect to the processing tray in a sheet conveyance direction.

The post-processing apparatus controls a switch between a processing mode and a non-processing mode (normal mode). The processing mode carries out a post-processing on a sheet. In the processing mode, the sheet to which the post-processing is carried out by the processing tray is discharged to the discharge tray via the standby tray.

On the other hand, the non-processing mode conveys the sheet as it is without carrying out the post-processing on the sheet. In the non-processing mode, the sheet is discharged to the discharge tray via the standby tray and the processing tray. Otherwise, in the non-processing mode, the sheet is discharged to the discharge tray via another route, but not the processing tray. For example, a route passing through the standby tray but not the processing tray is included in another route. However, if the sheet passes through the processing tray or another route, since an extra step until the discharge of the sheet to the discharge tray is required, there is a possibility of inhibiting a processing speed of the post-processing apparatus.

DETAILED DESCRIPTION

Figure 1:
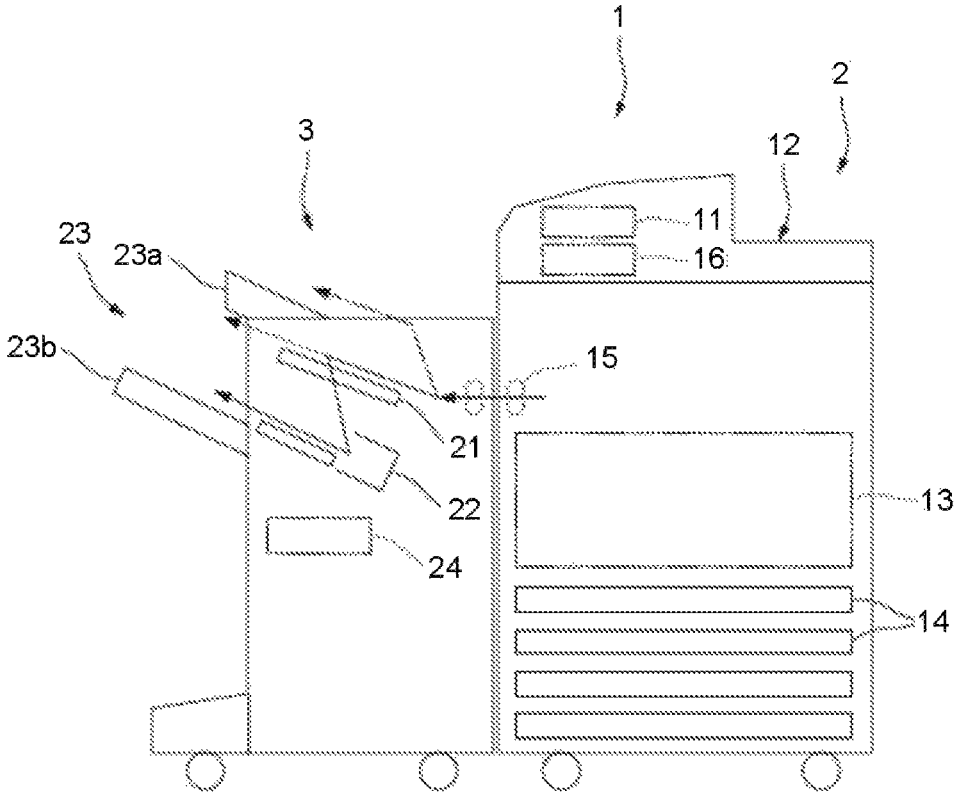
FIG. 1 is a front view illustrating an example of an image forming system according to an embodiment.

In accordance with an embodiment, a sheet processing apparatus comprises a first tray, a second tray, a third tray, a lower supporting plate, a drive section and a control device. The second tray is located at the lower part of the first tray. The third tray is located at a downstream side with respect to the second tray in a sheet conveyance direction. The lower supporting plate can support the sheet from the lower part. The drive section drives the lower supporting plate. The control device controls the drive section to arrange the lower supporting plate at the downstream side with respect to a conveyance starting point of the sheet in the sheet conveyance direction in a case of skipping the first tray and the second tray to convey the sheet to the third tray.

Hereinafter, a sheet processing apparatus of an embodiment is described with reference to the accompanying drawings. The same reference numerals are applied to the same elements in each figure.

FIG. 1 is a front view illustrating an example of an image forming system 1 according to the embodiment. As shown in FIG. 1, the image forming system 1 includes an image forming apparatus 2 and a post-processing apparatus 3. The image forming apparatus 2 forms an image on a sheet-like medium (hereinafter, referred to as a "sheet") such as a paper. The post-processing apparatus 3 carries out a post-processing on a sheet conveyed from the image forming apparatus 2. The post-processing apparatus 3 is an example of the "sheet processing apparatus".

The image forming apparatus 2 is equipped with a control panel 11, a scanner section 12, a printer section 13, a sheet feed section 14, a sheet discharge section 15 and an image forming control section 16.

The control panel 11 includes various keys for receiving operations of a user. For example, the control panel 11 receives an input relating to the type of the post-processing of the sheet. The control panel 11 sends the input information relating to the type of the post-processing to the post-processing apparatus 3.

The scanner section 12 is equipped with a reading section for reading image information of a copy object. The scanner section 12 sends the read image information to the printer section 13.

The printer section 13 forms an output image (hereinafter, referred to as a "toner image") with a developing agent such as toner on the basis of the image information sent from the scanner section 12 or an external device. The printer section 13 transfers the toner image on the surface of the sheet. The printer section 13 heats and pressures the toner image transferred on the sheet to fix the toner image on the sheet.

The sheet feed section 14 supplies the sheets to the printer section 13 one by one in accordance with a timing at which the printer section 13 forms the toner image.

The sheet discharge section 15 conveys the sheet discharged from the printer section 13 to the post-processing apparatus 3.

The image forming control section 16 controls whole operations of the image forming apparatus 2. In other words, the image forming control section 16 controls the control panel 11, the scanner section 12, the printer section 13, the sheet feed section 14 and the sheet discharge section 15. The image forming control section 16 is formed with a control circuit including a CPU, a ROM and a RAM.

Next, the post-processing apparatus 3 is described.

The post-processing apparatus 3 is arranged adjacent to the image forming apparatus 2. The post-processing apparatus 3 executes a post-processing designated via the control panel 11 on the sheet conveyed from the image forming apparatus 2. For example, the post-processing is a stapling processing or a sorting processing.

Figure 2:
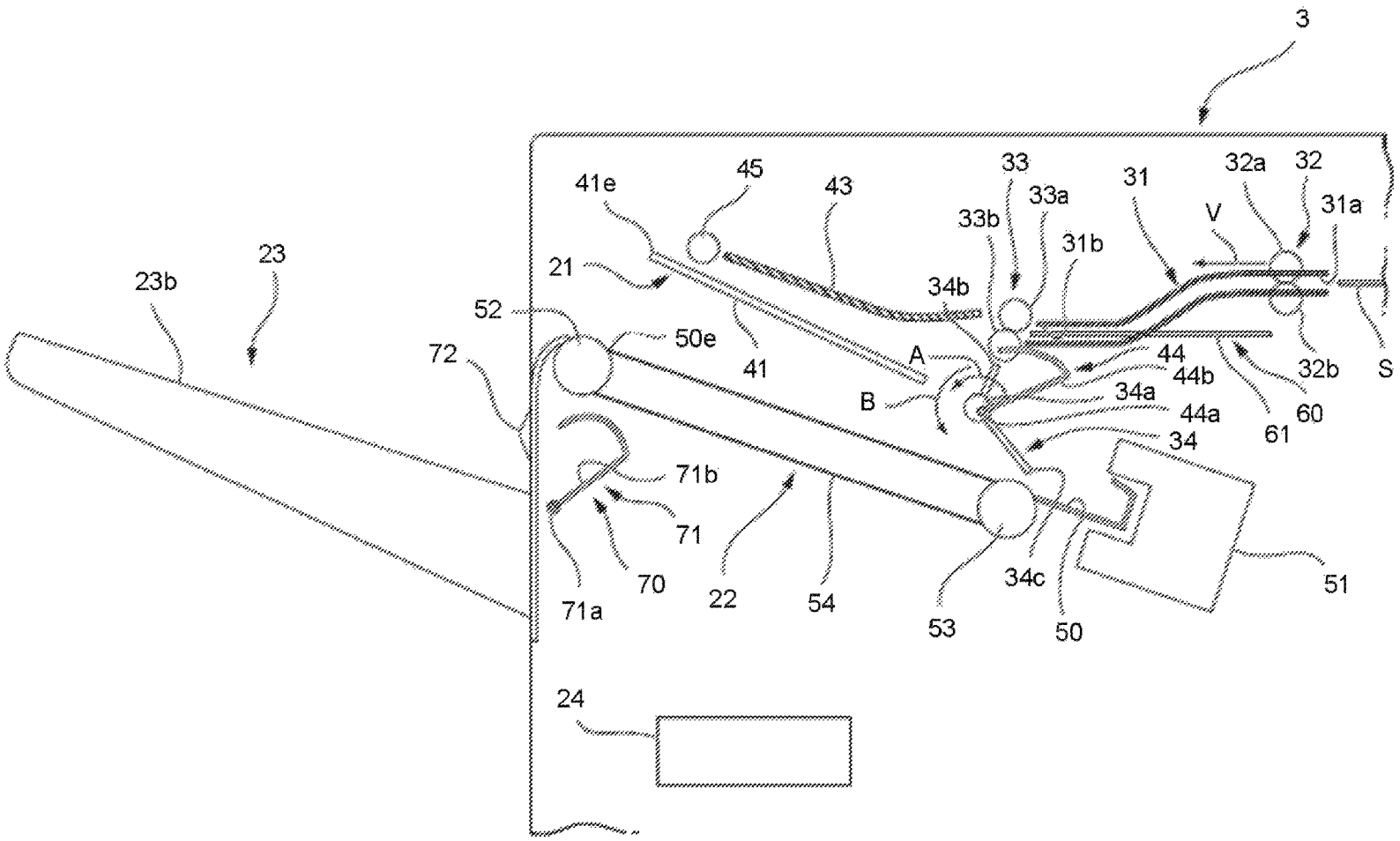
FIG. 2 is a cross-sectional view illustrating main portions of a post-processing apparatus according to the embodiment.

FIG. 2 is a cross-sectional view illustrating main portions of the post-processing apparatus 3 according to the embodiment. As shown in FIG. 2, the post-processing apparatus 3 is equipped with a conveyance path 31, an inlet side conveyance section 32, an outlet side conveyance section 33, a standby section 21, a processing section 22, a discharge section 23, a paddle section 34, a lower supporting section 60, a sheet height maintenance mechanism 70 and a post-processing control section 24.

Firstly, the conveyance path 31 is described.

The conveyance path 31 is arranged inside the post-processing apparatus 3. The conveyance path 31 is equipped with a sheet supply port 31*a* and a sheet discharge port 31*b*.

The sheet supply port 31*a* faces the image forming apparatus 2 (refer to FIG. 1). A sheet S is supplied from the image forming apparatus 2 to the sheet supply port 31*a*.

On the other hand, the sheet discharge port 31*b* is located at a position close to the standby section 21. The sheet S passing through the conveyance path 31 is discharged from the sheet discharge port 31*b* to the standby section 21 or the discharge section 23.

Next, the inlet side conveyance section 32 is described.

The inlet side conveyance section 32 is equipped with a pair of inlet rollers 32*a* and 32*b*. The inlet rollers 32*a* and 32*b* are arranged at positions close to the sheet supply port 31*a*. The inlet rollers 32*a* and 32*b* convey the sheet S supplied to the sheet supply port 31*a* towards a downstream side of the conveyance path 31. For example, the inlet rollers 32*a* and 32*b* convey the sheet S supplied to the sheet supply port 31*a* to the outlet side conveyance section 33.

Next, the outlet side conveyance section 33 is described.

The outlet side conveyance section 33 is equipped with a pair of outlet rollers 33*a* and 33*b*. The outlet rollers 33*a* and 33*b* are arranged at positions close to the sheet discharge port 31*b*. The outlet rollers 33*a* and 33*b* receive the sheet S conveyed by the inlet rollers 32*a* and 32*b*. The outlet rollers 33*a* and 33*b* can convey the sheet S from the sheet discharge port 31*b* to the standby section 21 or the discharge section 23.

In the embodiment, the sheet S is conveyed from the image forming apparatus 2 to the discharge section 23. Hereinafter, in a conveyance direction V of the sheet S (hereinafter, referred to as a "sheet conveyance direction V"), the image forming apparatus 2 side is set to an "upstream side". Further, in the sheet conveyance direction V, the discharge section 23 side is set to a downstream side.

Next, the standby section 21 is described.

The standby section 21 temporarily buffers a sheet S conveyed from the outlet side conveyance section 33. For example, the standby section 21 makes a plurality of succeeding sheets S stand by while the post-processing of the preceding sheet S is carried out by the processing section 22. The standby section 21 is arranged at the upper part of the processing section 22. The standby section 21 drops a buffered sheet S towards the processing section 22 if the processing section 22 is in a standby state.

Specifically, the standby section 21 is equipped with a standby tray 41, an opening and closing drive section 42 (refer to FIG. 3), an assist guide 43, a chuck section 44 and a conveyance roller 45.

The standby tray 41 is an example of a "first tray". The upstream end part of the standby tray 41 is located at a position close to the output roller 33*b*. The upstream end part of the standby tray 41 is located at the lower part with respect to the sheet discharge port 31*b* of the conveyance path 31. The standby tray 41 is inclined with respect to the horizontal direction so as to be positioned upwards towards the downstream side of the sheet conveyance direction V. The standby tray 41 piles up the plurality of the sheets S and makes the sheets S stand by while the post-processing is carried out by the processing section 22.

Figure 3:
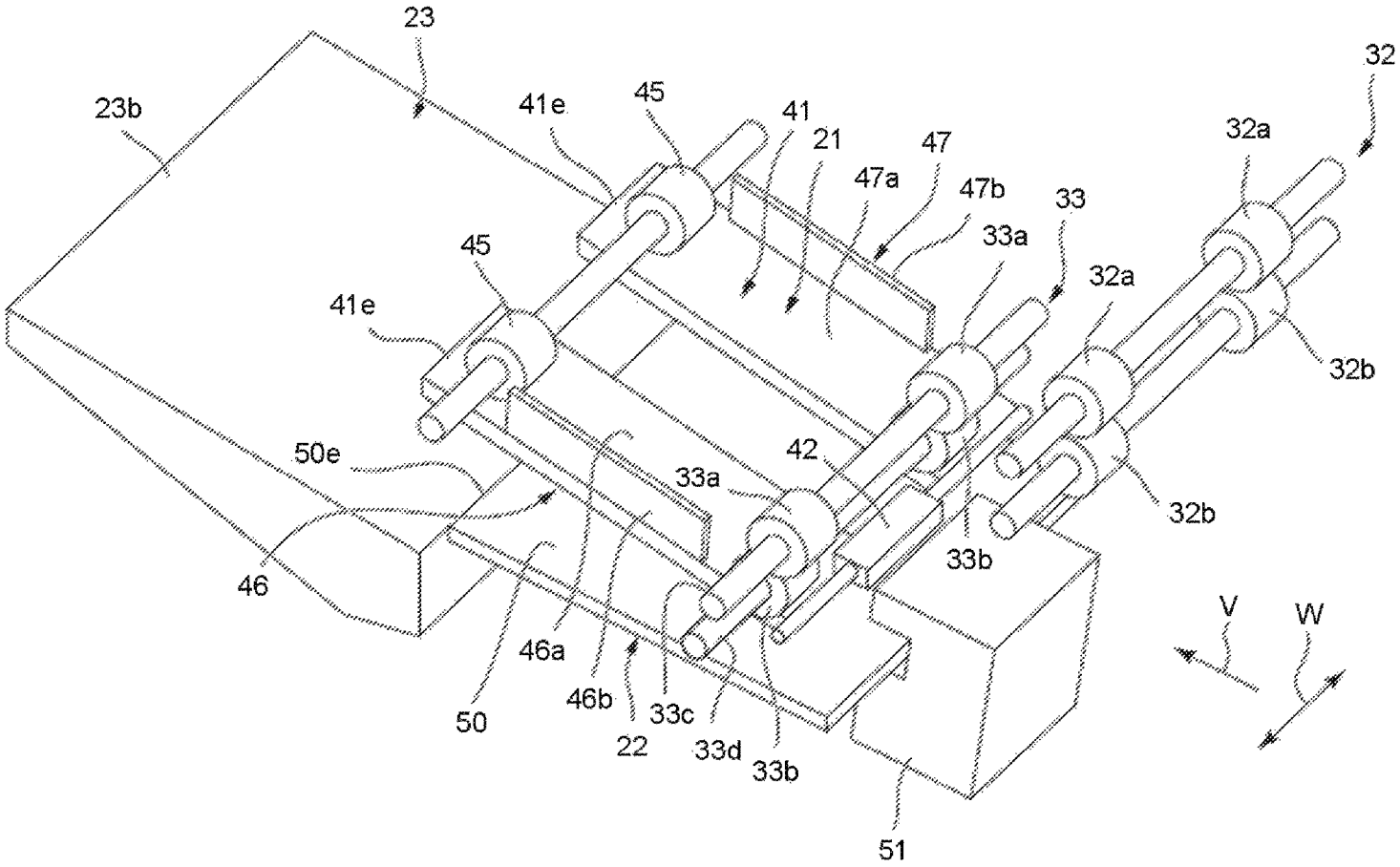
FIG. 3 is a perspective view illustrating the main portions of the post-processing apparatus according to the embodiment.

FIG. 3 is a perspective view illustrating the main portions of the post-processing apparatus 3 according to the embodiment. As shown in FIG. 3, the standby tray 41 is equipped with a first support member 46 and a second support member 47.

The first support member 46 and the second support member 47 are separated from each other in a direction crossing with the sheet conveyance direction V. Hereinafter, a width direction W of the sheet S is referred to as a "sheet width direction W". In the embodiment, the first support member 46 and the second support member 47 are substantially parallel to the horizontal direction, and separated from each other in the sheet width direction W substantially orthogonal to the sheet conveyance direction V. The first support member 46 and the second support member 47 are movable in directions close to each other and in directions separated from each other in the sheet width direction W.

The first support member 46 and the second support member 47 respectively include bottom walls 46*a* and 47*a* and side walls 46*b* and 47*b*. The bottom walls 46*a* and 47*a* are formed in a plate shape having a length in the sheet conveyance direction V. The bottom walls 46*a* and 47*a* can support the sheet S from the lower part. The side walls 46*b* and 47*b* stand upwards from outer ends of the bottom walls 46*a* and 47*a* in the sheet width direction W. The side walls 46*b* and 47*b* can support sides of the sheet S in the sheet width direction W.

The opening and closing drive section 42 can drive the first support member 46 and the second support member 47 in directions close to each other and in directions separated from each other.

The opening and closing drive section 42 sets a state in which the first support member 46 and the second support member 47 are close to each other in a case in which a sheet S stands by on the standby tray 41. In this way, the sheet S is supported by the first support member 46 and the second support member 47.

On the other hand, the opening and closing drive section 42 makes the first support member 46 and the second support member 47 separated from each other in a case in which the sheet S is moved from the standby tray 41 towards a processing tray 50 of the processing section 22. In this way, the sheet S supported by the standby tray 41 drops from a gap between the first support member 46 and the second support member 47 towards the processing tray 50. In this way, the sheet S is moved from the standby tray 41 to the processing tray 50.

As shown in FIG. 2, the assist guide 43 is arranged at the upper part of the standby tray 41. The assist guide 43 is an example of an "upper part covering section". The assist guide 43 is a plate-shaped member extending to the upper part of the standby tray 41. The upstream end part of the assist guide 43 is located at a position close to the output roller 33*a*. The upstream end part of the assist guide 43 is located slightly above the sheet discharge port 31*b* of the conveyance path 31. The assist guide 43 is crooked and extended so as to be positioned upwards towards the downstream side of the sheet conveyance direction V after being gradually curved so as to be positioned downwards towards the downstream side of the sheet conveyance direction V.

The sheet S discharged from the outlet rollers 33*a* and 33*b* enters a gap between the assist guide 43 and the standby tray 41. The sheet S entering the standby section 21 is guided by the assist guide 43 and the standby tray 41 to advance towards the inside of the standby section 21.

The chuck section 44 is arranged at the upstream side with respect to the standby tray 41 in the sheet conveyance direction V. The chuck section 44 can maintain the height of the uppermost surface of the sheet S conveyed to the standby tray 41 to a certain height. The chuck section 44 presses the upstream end part of the sheet S conveyed to the standby tray 41 towards the standby tray 41 through its own rotation.

Specifically, the chuck section 44 is equipped with a rotation axis 44*a* and an arm section 44*b*.

The rotation axis 44*a* is located at the upstream side with respect to the standby tray 41 in the sheet conveyance direction V. The rotation axis 44*a* is located at the lower part of the standby tray 41. The rotation axis 44*a* has a length in the sheet width direction W. The chuck section 44 is rotatable in an arrow A direction around the rotation axis 44*a*. The L-shaped arm section 44*b* is mounted on the rotation axis 44*a*.

For example, the chuck section 44 presses the upstream end of the sheet S towards the standby tray 41 by being rotated in accordance with a timing at which the sheet S is discharged from the outlet rollers 33*a* and 33*b* towards the standby tray 41. In this way, it can be suppressed that the upstream end of the sheet S floats on the standby tray 41.

The conveyance roller 45 is arranged at a position close to a downstream end 41*e* of the standby tray 41. As shown in FIG. 3, the conveyance rollers 45 are movable in directions close to the bottom walls 46*a* and 47*a* of the standby tray 41 and in directions separated from the bottom walls 46*a* and 47*a* of the standby tray 41. The conveyance rollers 45 can move the sheet S to fixed positions on the bottom walls 46*a* and 47*a* of the standby tray 41 in a case in which the sheet S stands by on the standby tray 41.

Next, the processing section 22 is described.

The processing section 22 carries out a post-processing on a sheet S. For example, the processing section 22 aligns a plurality of sheets S. The processing section 22 carries out a stapling processing on the plurality of the aligned sheets S. In this way, the plurality of the sheets S is bound together. The processing section 22 discharges the sheets S to which the post-processing is carried out to the discharge section 23.

As shown in FIG. 2, the processing section 22 is equipped with the processing tray 50, a stapler 51, drive rollers 52 and 53 and a conveyance belt 54.

The processing tray 50 is an example of a "second tray". As shown in FIG. 3, the processing tray 50 is located at the lower part of the standby tray 41. The processing tray 50 is inclined with respect to the horizontal direction so as to be positioned upwards towards the downstream side of the sheet conveyance direction V. In the embodiment, the processing tray 50 is inclined more slightly and gently than the standby tray 41 with respect to the horizontal direction. In the sheet conveyance direction V, a downstream end 50*e* of the processing tray 50 is located at the downstream side with respect to the downstream end 41*e* of the standby tray 41. The plurality of the sheets S moving to the processing tray 50 is aligned in the sheet width direction W and the sheet conveyance direction V with an alignment plate (not shown).

The stapler 51 is arranged at an end part of the processing tray 50. The stapler 51 carries out the stapling (binding) processing on a bundle of a predetermined number of sheets S located on the processing tray 50.

As shown in FIG. 2, the drive rollers 52 and 53 are arranged in the sheet conveyance direction V at a predetermined interval. The conveyance belt 54 is stretched over the drive rollers 52 and 53. The downstream end part of the conveyance belt 54 is overlapped with the downstream end 50*e* of the processing tray 50 when viewed from the sheet width direction W. The conveyance belt 54 is rotated in synchronization with the drive rollers 52 and 53. The conveyance belt 54 can convey the sheet S between the stapler 51 and the movable tray 23*b*.

Next, the discharge section 23 is described.

As shown in FIG. 1, the discharge section 23 is equipped with a fixed tray 23*a* and a movable tray 23*b*. The fixed tray 23*a* is arranged on the upper part of the post-processing apparatus 3. The movable tray 23*b* is arranged on a side of the post-processing apparatus 3. The movable tray 23*b* is an example of a "third tray". The sheets S to which the sorting processing is carried out are discharged to the fixed tray 23*a* and the movable tray 23*b*.

Next, the paddle section 34 is described.

As shown in FIG. 2, the paddle section 34 is arranged between the standby tray 41 and the processing tray 50. In other words, the paddle section 34 is arranged at the lower part of the standby tray 41 and at the upper part of the processing tray 50. The paddle section 34 presses the sheet S towards the processing tray 50 through its own rotation in a case in which the sheet S is moved from the standby tray 41 towards the processing tray 50. Furthermore, the paddle section 34 moves the sheet S dropped to the processing tray 50 towards the stapler 51.

Specifically, the paddle section 34 is equipped with a rotation axis 34*a*, a first paddle 34*b* and a second paddle 34*c*.

The rotation axis 34*a* is a central axis of the paddle section 34. The rotation axis 34*a* of the paddle section 34 is overlapped with the rotation axis 44*a* of the chuck section 44 when viewed from the sheet width direction W. The rotation axis 34*a* has a length in the sheet width direction W. The paddle section 34 is rotatable in an arrow B direction around the rotation axis 34*a*. The first paddle 34*b* and the second paddle 34*c* are mounted on the rotation axis 34*a*.

For example, the first paddle 34*b* and the second paddle 34*c* are formed with an elastic material such as gum. The first paddle 34*b* and the second paddle 34*c* protrude from the rotation axis 34*a* towards the external side of the diameter direction of the rotation axis 34*a*. The length of the protrusion of the second paddle 34*c* is longer than that of the protrusion of the first paddle 34*b*. The second paddle 34*c* is located at the behind of the first paddle 34*b* in the rotation direction of the paddle section 34.

For example, the first paddle 34*b* presses the sheet S towards the processing tray 50 by being rotated in accordance with a timing at which the sheet S is moved from the standby tray 41 towards the processing tray 50. In this way, even in a case in which the sheet S is sticking to the assist guide 43, the sheet S is easily peeled off from the assist guide 43.

The second paddle 34*c* is rotated to be come in contact with the upper surface of the sheet S located at the highest position among the plurality of the sheets S dropped to the processing tray 50. The second paddle 34*c* is further rotated in a state of coming in contact with the upper surface of the sheet S to move the sheet S towards the stapler 51.

Next, the lower supporting section 60 is described.

The lower supporting section 60 is arranged at a position close to the outlet side conveyance section 33.

Figure 4:
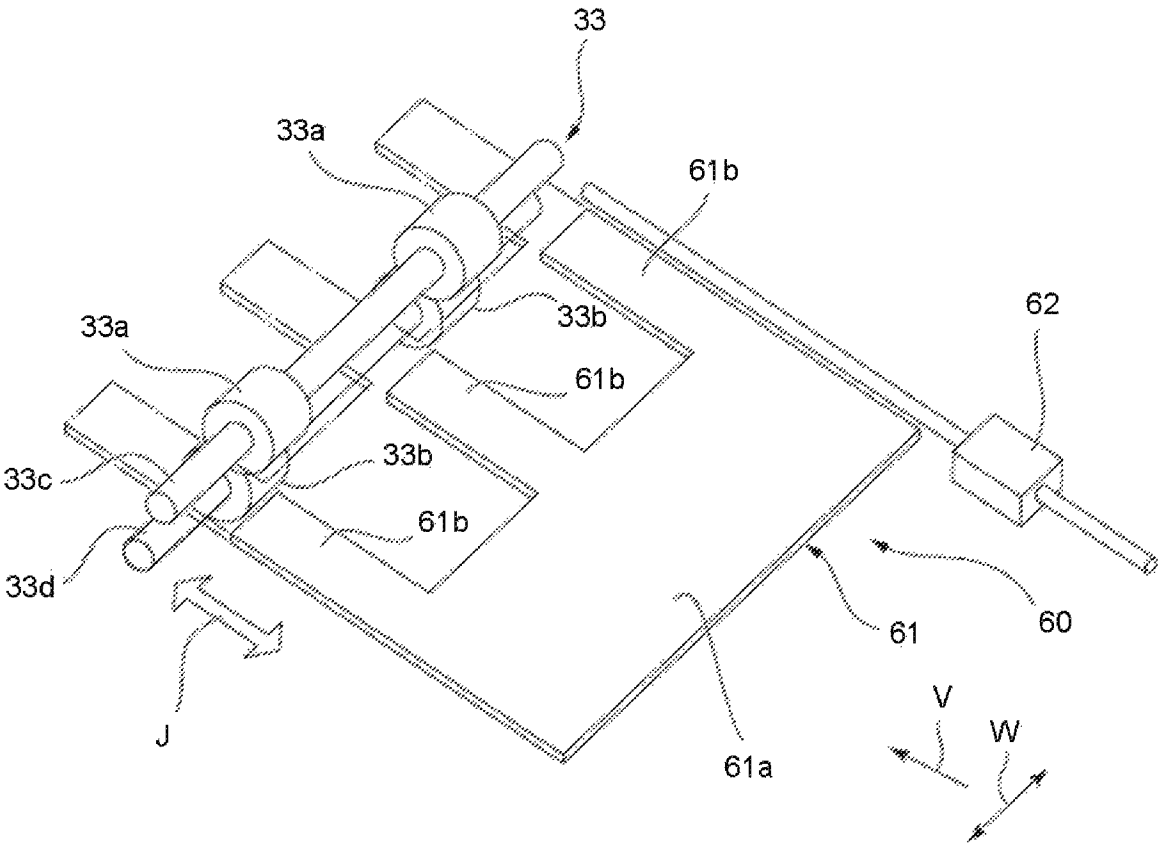
FIG. 4 is a perspective view illustrating a lower supporting section according to the embodiment.

FIG. 4 is a perspective view illustrating the lower supporting section 60 according to the embodiment. As shown in FIG. 4, the lower supporting section 60 is equipped with a lower supporting plate 61 and an advance and retreat drive section (drive section).

The lower supporting plate 61 can support the sheet S from the lower part. The lower supporting plate 61 is formed in a pectinate shape. The lower supporting plate 61 is equipped with a lower supporting plate main body 61*a* and a lower supporting piece 61*b*. The lower supporting plate main body 61*a* is formed in a rectangular shape having a length in the sheet width direction W. A plurality of the lower supporting pieces 61*b* is connected with the downstream end of the lower supporting plate main body 61*a* in the sheet conveyance direction V. The lower supporting piece 61*b* is formed in a rectangular shape having a length in the sheet conveyance direction V. The lower supporting piece 61*b* protrudes from the downstream end of the lower supporting plate main body 61*a* towards the outlet side conveyance section 33. The plurality of the lower supporting pieces 61*b* is arranged separately in the sheet width direction W.

In FIG. 4, three lower supporting pieces 61*b* are shown. In the sheet width direction W, an interval between two adjacent lower supporting pieces 61*b* has substantially the same size. The three lower supporting pieces 61*b* are arranged one by one at the center and both ends of the lower supporting plate main body 61*a* in the sheet width direction W. The lower supporting piece 61*b* is arranged at a position corresponding to a space between a pair of shafts 33*c* and 33*d* for supporting the outlet rollers 33*a* and 33*b*.

The advance and retreat drive section 62 can move the lower supporting plate 61 between a position of the upstream side with respect to the outlet side conveyance section 33 and a position of the downstream side with respect to the outlet side conveyance section 33 in the sheet conveyance direction V. Hereinafter, in the sheet conveyance direction V, the position of the upstream side with respect to the outlet side conveyance section 33 is referred to as a "first position", and the position of the downstream side with respect to the outlet side conveyance section 33 is referred to as a "second position". The advance and retreat drive section 62 can drive the lower supporting plate 61 in an arrow J direction between the first position and the second position. In FIG. 2, a state in which the lower supporting plate 61 is located at the first position is shown.

The advance and retreat drive section 62 moves the lower supporting plate 61 to the first position in a case in which the sheet S is moved from the standby tray 41 towards the processing tray 50 of the processing section 22. In this way, the sheet S supported by the standby tray 41 avoids the lower supporting plate 61 to be dropped towards the processing tray 50 from the gap between the first support member 46 and the second support member 47. In this way, the sheet S is moved from the standby tray 41 to the processing tray 50.

While the lower supporting plate 61 is moved from the first position to the second position, the lower supporting plate main body 61*a* is located at the upstream side with respect to the outlet side conveyance section 33. While the lower supporting plate 61 is moved from the first position to the second position, the lower supporting piece 61*b* passes through a gap between the pair of the shafts 33*c* and 33*d*. The solid line shown in FIG. 4 indicates a state in which the lower supporting plate 61 is located at the first position. The two-dot chain line shown in FIG. 4 indicates a state in which the lower supporting plate 61 is located at the second position.

Next, the sheet height maintenance mechanism 70 is described.

As shown in FIG. 2, the sheet height maintenance mechanism 70 is arranged at a position close to the movable tray 23*b*. The sheet height maintenance mechanism 70 can maintain the height of the uppermost surface of the sheet S conveyed to the movable tray 23*b* to a certain height. The sheet height maintenance mechanism 70 is equipped with a chuck section 71 and a sheet detection sensor 72.

The chuck section 71 presses the upstream end part of the sheet S discharged to the movable tray 23*b* towards the movable tray 23*b* through its own rotation. Specifically, the chuck section 71 is equipped with a rotation axis 71*a* and an arm section 71*b*.

The rotation axis 71*a* is located at the upstream side with respect to the movable tray 23*b* in the sheet conveyance direction V. The rotation axis 71*a* is located at the lower part of the drive roller 52. The rotation axis 71*a* has a length in the sheet width direction W.

Figure 5:
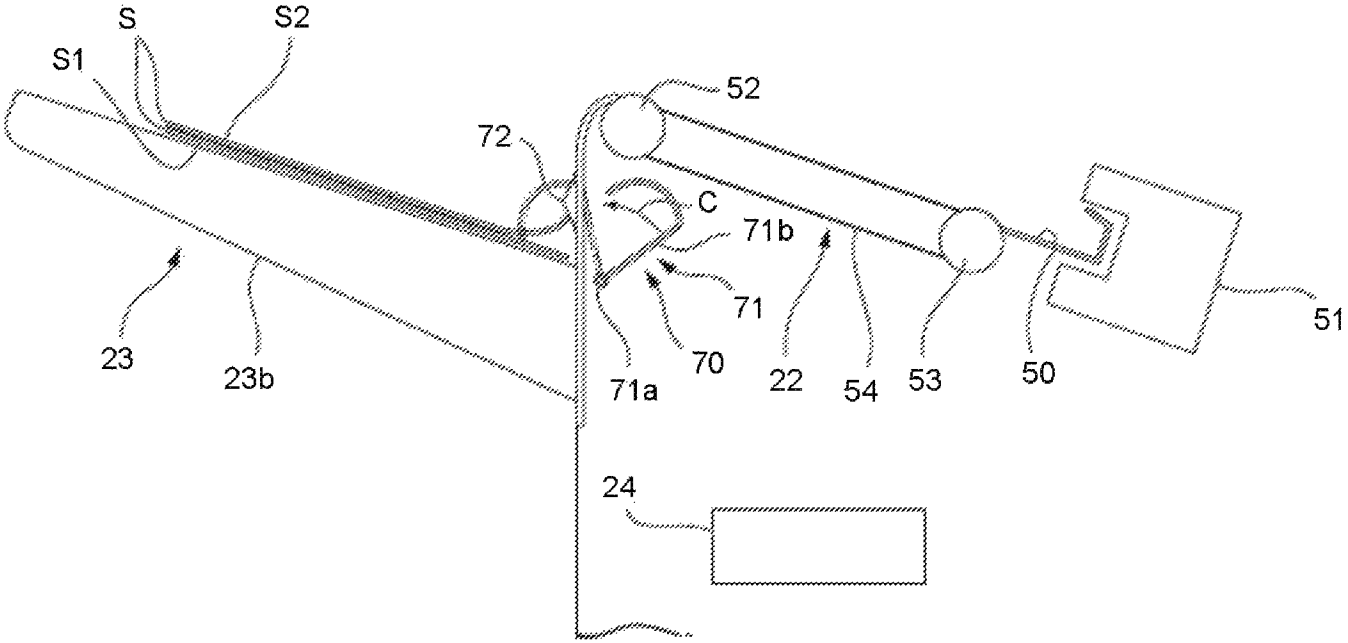
FIG. 5 is a view illustrating an example of operations of a sheet height maintenance mechanism according to the embodiment.

FIG. 5 is a view illustrating an example of operations of the sheet height maintenance mechanism 70 according to the embodiment. As shown in FIG. 5, the chuck section 71 is rotatable in an arrow C direction around the rotation axis 71*a*. The L-shaped arm section 71*b* is mounted on the rotation axis 71*a*.

For example, the chuck section 71 presses the upstream end of the sheet S towards the movable tray 23*b* by being rotated in accordance with a timing at which the sheet S is discharged from the conveyance belt 54 towards the movable tray 23*b*. In this way, it is possible that the upstream end of the sheet S floats on the movable tray 23*b*.

In FIG. 5, a sheet normally placed on the movable tray 23*b* is indicated by a symbol S1. A sheet of which the upstream end floats on the movable tray 23*b* is indicated by a symbol S2. Further, a state in which the chuck section 71 presses the upstream end of the sheet S towards the movable tray 23*b* is indicated by the two-dot chain line.

As shown in FIG. 2, the sheet detection sensor 72 is arranged on a side of the post-processing apparatus 3. The sheet detection sensor 72 is located at the upper part of the upstream end of the movable tray 23*b*. The sheet detection sensor 72 protrudes from the side of the post-processing apparatus 3 towards the upper part of the movable tray 23*b*. The sheet detection sensor 72 detects a placement state of the sheet S on the movable tray 23*b*. For example, the sheet detection sensor 72 is a contact type sensor. For example, in a case in which the upstream end of the sheet S is connected with the sheet detection sensor 72, the sheet detection sensor 72 detects that the upstream end of the sheet S is floating on the movable tray 23*b*. A detection result of the sheet detection sensor 72 is output to the post-processing control section 24.

Next, the post-processing control section 24 is described.

Figure 6:
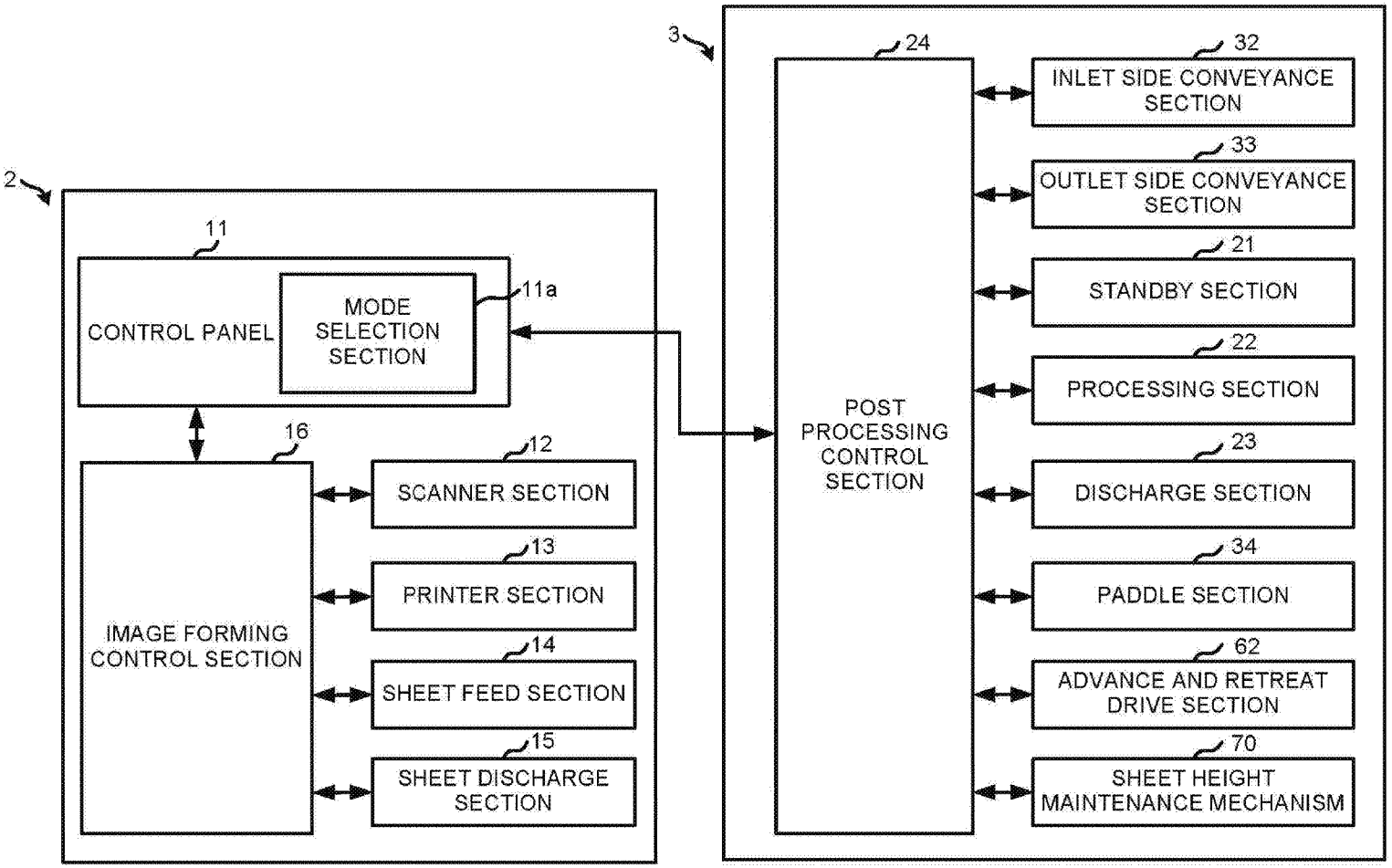
FIG. 6 is a block diagram illustrating an example of the image forming system according to the embodiment.

FIG. 6 is a block diagram illustrating an example of the image forming system 1 according to the embodiment. As shown in FIG. 6, the post-processing control section 24 controls whole operations of the post-processing apparatus 3. In other words, the post-processing control section 24 controls the inlet side conveyance section 32, the outlet side conveyance section 33, the standby section 21, the processing section 22, the discharge section 23, the paddle section 34, the advance and retreat drive section 62 and the sheet height maintenance mechanism 70. The post-processing control section 24 is formed with a control circuit including a CPU, a ROM and a RAM. The post-processing control section 24 is an example of a "control device".

For example, the post-processing control section 24 controls a switch between a processing mode and a non-processing mode (normal mode). The processing mode refers to a mode for carrying out the post-processing on the sheet S. The non-processing mode refers to a mode for conveying the sheet S as it is without carrying out the post-processing on the sheet S.

The control panel 11 is equipped with a mode selection section 11*a* capable of selecting the processing mode and the non-processing mode. For example, the mode selection section 11*a* is a button arranged on the control panel 11. The user selects the "processing mode" at the time of the mode selection to press the button, and in this way, the post-processing control section 24 carries out the post-processing on the sheet S. On the other hand, the user selects the "non-processing mode" at the time of the mode selection to press the button, and in this way, the post-processing control section 24 discharges the sheet S as it is without carrying out the post-processing on the sheet S.

The sheet discharge method according to the embodiment skips a standby step of making a sheet S stand by and a processing step for processing the sheet S to discharge the sheet S after arranging the lower supporting plate 61 at the downstream side with respect to a conveyance starting point of the sheet S in the sheet conveyance direction V. The conveyance starting point of the sheet S refers to a starting point at which the sheet S is conveyed in a case of skipping the standby section 21 and the processing section 22 to convey the sheet S towards the discharge section 23. In the embodiment, the conveyance starting point of the sheet S is a position at which the outlet side conveyance section 33 is arranged. Specifically, the sheet discharge method of the embodiment arranges the lower supporting plate 61 at the downstream side with respect to the conveyance starting point of the sheet S in the sheet conveyance direction V in the non-processing mode.

In other words, the post-processing control section 24 controls the advance and retreat drive section 62 to arrange the lower supporting plate 61 at the downstream side with respect to the conveyance starting point of the sheet S in the sheet conveyance direction V in a case of skipping the standby section 21 and the processing section 22 to convey the sheet S towards the discharge section 23. Specifically, the post-processing control section 24 controls the advance and retreat drive section 62 to arrange the lower supporting plate 61 at the downstream side with respect to the conveyance starting point of the sheet S in the sheet conveyance direction V in the non-processing mode. Hereinafter, a route in which the sheet S is moved towards the discharge section 23 skipping the standby section 21 and the processing section 22 is referred to as a "skip route". The skip route refers to a route in which the sheet S is directly moved towards the movable tray 23*b* without passing through the standby tray 41 and the processing tray 50. In the following figure, the skip route is indicated by an arrow K (FIG. 7).

Next, an example of the operations of the post-processing apparatus 3 according to the embodiment is described.

As shown in FIG. 3, in the post-processing apparatus 3, the standby tray 41 is movable in order to avoid the skip route (arrow K shown in FIG. 7) of the sheet S. Specifically, the first support member 46 and the second support member 47 can be separated from each other in the sheet width direction W in order to avoid the skip route of the sheet S. The post-processing control section 24 controls the opening and closing drive section 42 so that the first support member 46 and the second support member 47 are separated from each other before skipping the standby tray 41 and the processing tray 50 to convey the sheet S towards the movable tray 23*b*.

Figure 7:
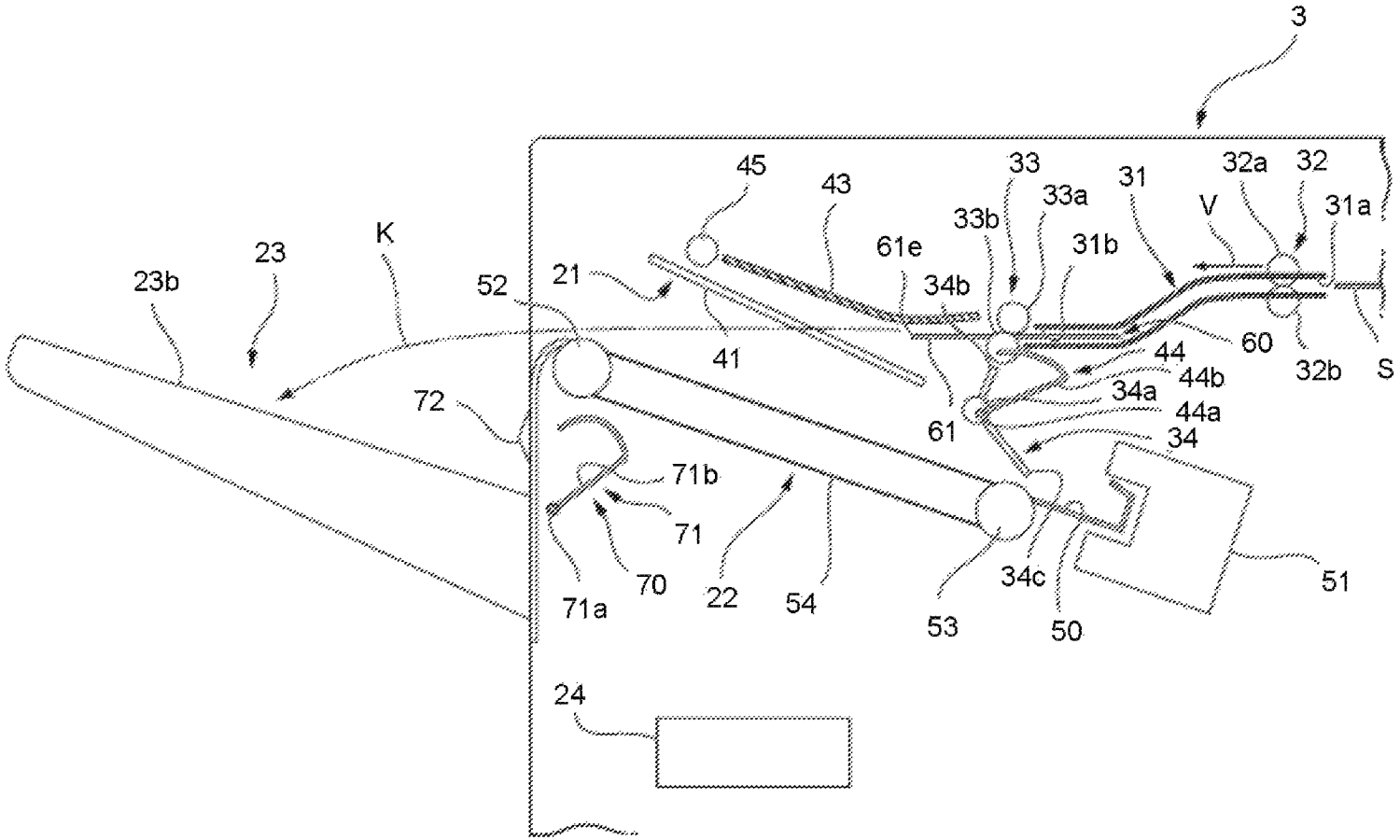
FIG. 7 is a view illustrating an example of operations of the post-processing apparatus according to the embodiment.

FIG. 7 is a view illustrating an example of the operations of the post-processing apparatus 3 according to the embodiment.

As shown in FIG. 7, the assist guide 43 covers the sheet S from the upper part at the time of skipping the standby tray 41 and the processing tray 50 to convey the sheet S towards the movable tray 23*b*. In other words, the assist guide 43 is located at the upper side of the skip route at the time of skipping the standby tray 41 and the processing tray 50 to convey the sheet S towards the movable tray 23*b*.

The lower supporting plate 61 supports the sheet S from the lower part at the time of skipping the standby tray 41 and the processing tray 50 to convey the sheet S towards the movable tray 23*b*. In other words, the lower supporting plate 61 is located at the lower side of the skip route at the time of skipping the standby tray 41 and the processing tray 50 to convey the sheet S towards the movable tray 23*b*. A downstream end part 61*e* of the lower supporting plate 61 in the sheet conveyance direction V is directed towards the movable tray 23*b* at the time of skipping the standby tray 41 and the processing tray 50 to convey the sheet S towards the movable tray 23*b*.

The post-processing control section 24 controls the advance and retreat drive section 62 so that the lower supporting plate 61 is moved to the second position before skipping the standby tray 41 and the processing tray 50 to convey the sheet S towards the movable tray 23*b*. The post-processing control section 24 stops the lower supporting plate 61 at the second position in the non-processing mode. In the non-processing mode, the sheet S is guided towards the movable tray 23*b* by the lower supporting plate 61. In this way, in the non-processing mode, the sheet S skips the standby tray 41 and the processing tray 50 to be conveyed towards the movable tray 23*b*.

The post-processing control section 24 controls the chuck section 71 so that the upstream end of the sheet S is pressed towards the movable tray 23*b* at the time the upstream end of the sheet S is floating on the movable tray 23*b* on the basis of a detection result of the sheet detection sensor 72. As shown in FIG. 5, the chuck section 71 rotates in the arrow C direction to press the upstream end of the sheet S towards the movable tray 23*b*.

Incidentally, at the time the sheet is discharged to the discharge tray, there is a possibility of inhibiting a processing speed of the post-processing apparatus 3 through a conveyance route of the sheet.

Figure 8:
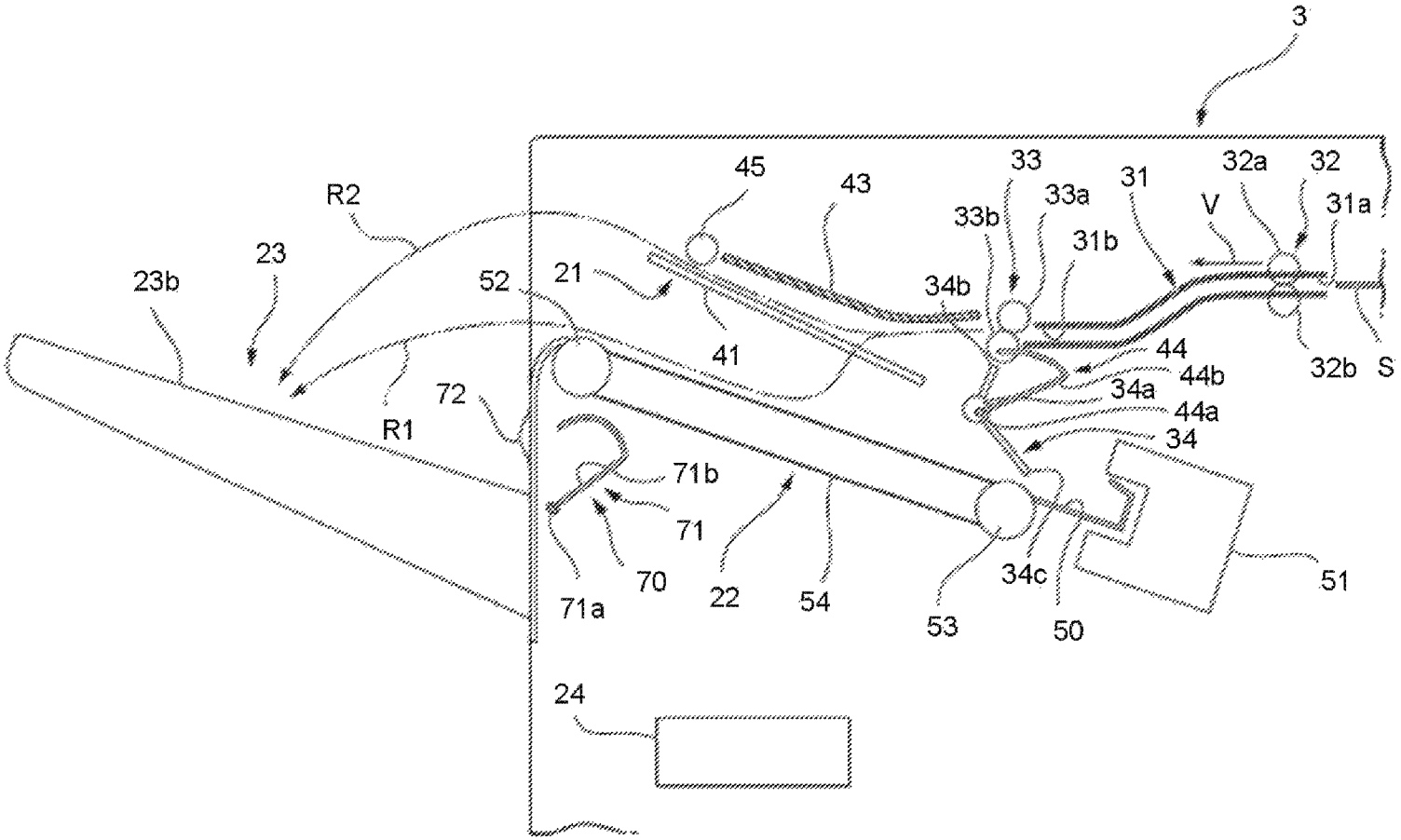
FIG. 8 is a view illustrating an example of a sheet discharge method of a comparative embodiment.

FIG. 8 is a view illustrating an example of a sheet discharge method of a comparative embodiment. In FIG. 8, the "movable tray 23*b*" is shown as an example of the discharge tray.

As indicated by an arrow R1 in FIG. 8, in the non-processing mode, the sheet S is discharged to the movable tray 23*b* via the standby tray 41 and the processing tray 50. Otherwise, in the non-processing mode, the sheet S is discharged to the movable tray 23*b* via another route but not the processing tray 50. For example, as indicated by an arrow R2 in FIG. 8, a route passing through the standby tray 41 but not the processing tray 50 is included in another route.

For example, in a case of only passing through the standby tray 41, the conveyance roller 45 conveys the sheet S towards the movable tray 23*b* of the discharge section 23 so that the sheet S is directly discharged from the standby tray 41 to the discharge section 23. However, if the sheet passes through the processing tray 50 or another route, since an extra way until the discharge of the sheet S to the movable tray 23*b* is required, there is a possibility of inhibiting the processing speed of the post-processing apparatus 3.

According to the embodiment, the post-processing apparatus 3 is equipped with the standby tray 41, the processing tray 50, the movable tray 23*b*, the lower supporting plate 61, the advance and retreat drive section 62 and the post-processing control section 24. The processing tray 50 is located at the lower part of the standby tray 41. The movable tray 23*b* is located at the downstream side with respect to the processing tray 50 in the sheet conveyance direction V. The lower supporting plate 61 can support the sheet S from the lower part. The advance and retreat drive section 62 drives the lower supporting plate 61. The post-processing control section 24 controls the advance and retreat drive section 62 to arrange the lower supporting plate 61 at the downstream side with respect to the conveyance starting point of the sheet S in the sheet conveyance direction V in a case of skipping the standby tray 41 and the processing tray 50 to convey the sheet S towards the movable tray 23*b*. According to the foregoing constitution, the following effects work. In a case of conveying the sheet S, the extra way until the discharge of the sheet S to the movable tray 23*b* is not required by skipping the standby tray 41 and the processing tray 50 to convey the sheet S towards the movable tray 23*b*. Thus, the processing speed of the post-processing apparatus 3 can be improved. In addition, the operations of the post-processing apparatus 3 are reduced since the sheet does not pass through the standby tray 41 and the processing tray 50. Thus, noise can be suppressed and power consumption can be reduced. In addition, in a case of skipping the standby tray 41 and the processing tray 50 to convey the sheet S towards the movable tray 23*b*, the following effects work by arranging the lower supporting plate 61 at the downstream side with respect to the conveyance starting point of the sheet S in the sheet conveyance direction V. At the time of skipping the standby tray 41 and the processing tray 50 to convey the sheet S towards the movable tray 23*b*, the lower surface of the sheet S can be guided by the lower supporting plate 61. Thus, it becomes easy to stably discharge the sheet S towards the movable tray 23*b*.

The post-processing control section 24 controls the advance and retreat drive section 62 to arrange the lower supporting plate 61 at the downstream side with respect to the conveyance starting point of the sheet S in the sheet conveyance direction V in the non-processing mode. According to the foregoing constitution, the following effects work. In the non-processing mode, the processing speed of the post-processing apparatus 3 can be improved. In particular, it is ideal in a case in which use frequency of the non-processing mode is higher than that of the processing mode.

The following effects work in such a manner that the standby tray 41 is movable in order to avoid the skip route of the sheet S. By moving the standby tray 41 to avoid the skip route of the sheet S, at the time of skipping the standby tray 41 and the processing tray 50 to convey the sheet S towards the movable tray 23*b*, the sheet S avoiding the standby tray 41 can be conveyed. Thus, the discharge of the sheet S can be smoothly carried out along the skip route.

The standby tray 41 is equipped with the first support member 46 and the second support member 47 capable of supporting the sheet S from the lower part. The first support member 46 and the second support member 47 can be separated from each other in the sheet width direction W in order to avoid the skip route. According to the foregoing constitution, the following effects work. Compared with a constitution in which a single standby tray is moved, the separation operation of the first support member 46 and the second support member 47 can be smoothly carried out. In addition, compared with a constitution in which the first support member 46 and the second support member 47 are separated in the sheet conveyance direction V, since an operation space to the sheet conveyance direction V is not required, enlargement to the sheet conveyance direction V of the post-processing apparatus 3 can be suppressed.

The downstream end part 61*e* of the lower supporting plate 61 in the sheet conveyance direction V is directed towards the movable tray 23*b* at the time of skipping the standby tray 41 and the processing tray 50 to convey the sheet S towards the movable tray 23*b*. According to the foregoing constitution, the following effects work. At the time of skipping the standby tray 41 and the processing tray 50 to convey the sheet S towards the movable tray 23*b*, it becomes easy to determine the conveyance direction of the sheet S. Thus, it becomes easy to discharge the sheet S towards the movable tray 23*b* more stably.

The assist guide 43 for covering the sheet S from the upper part is further included at the time of skipping the standby tray 41 and the processing tray 50 to convey the sheet S towards the movable tray 23*b*. According to the foregoing constitution, the following effects work. The upper part of the sheet S can be guided by the assist guide 43 at the time of skipping the standby tray 41 and the processing tray 50 to convey the sheet S towards the movable tray 23*b*. Thus, it becomes easy to stably discharge the sheet S towards the movable tray 23*b*.

The following effects work by further including the sheet height maintenance mechanism 70 capable of maintaining the height of the uppermost surface of the sheet S conveyed to the movable tray 23*b* to a certain height. At the time of skipping the standby tray 41 and the processing tray 50 to convey the sheet S towards the movable tray 23*b*, the landing height of the sheet S on the movable tray 23*b* can be maintained to a certain height. Thus, the sheets S can be stably piled up on the movable tray 23*b*.

According to the embodiment, the sheet discharge method skips the standby step of making the sheet S stand by and the processing step for processing the sheet S to discharge the sheet S after arranging the lower supporting plate 61 capable of supporting the sheet S from the lower part at the downstream side with respect to the conveyance starting point of the sheet S in the sheet conveyance direction V. According to the foregoing constitution, the following effects work. In a case of discharging the sheet S, the extra steps until the discharge of the sheet S are not required by skipping the standby step and the processing step to discharge the sheet S. Thus, the processing speed at the time of the discharge of the sheet S can be improved. In addition, in a case of skipping the standby step and the processing step to discharge the sheet S, the following effects work by previously arranging the lower supporting plate 61 at the downstream side with respect to the conveyance starting point of the sheet S in the sheet conveyance direction V. At the time of skipping the standby step and the processing step to discharge the sheet S, the lower surface of the sheet S can be guided by the lower supporting plate 61. Thus, it becomes easy to stably discharge the sheet S.

In the non-processing mode, the following effects work by arranging the lower supporting plate 61 at the downstream side with respect to the conveyance starting point of the sheet S in the sheet conveyance direction V. In the non-processing mode, the processing speed of the post-processing apparatus 3 can be improved. In particular, it is ideal in a case in which the use frequency of the non-processing mode is higher than that of the processing mode.

Hereinafter, modification is described.

Figure 9:
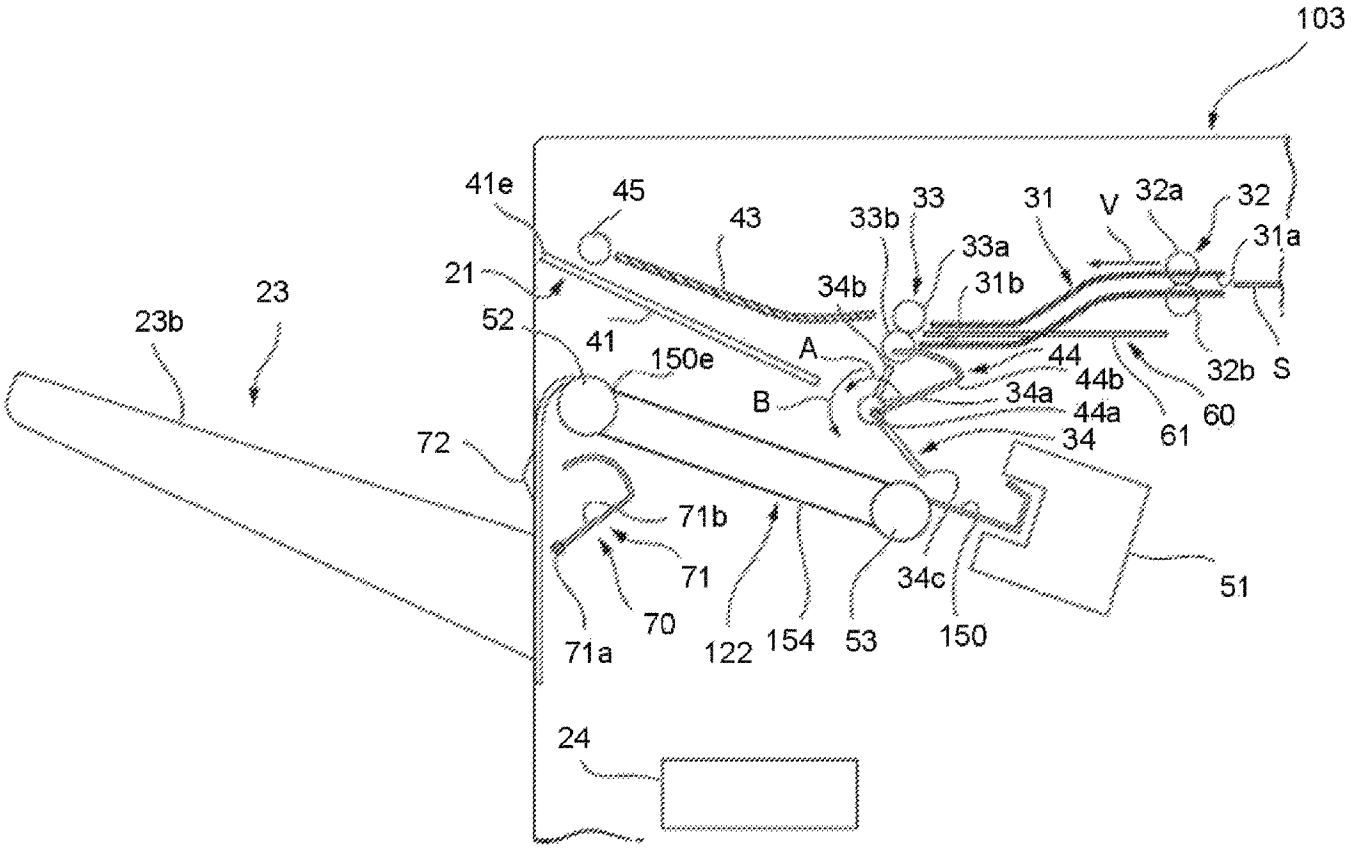
FIG. 9 is a cross-sectional view illustrating main portions of a post-processing apparatus according to a modification of the embodiment.

In the sheet conveyance direction V, the downstream end 50*e* of the processing tray 50 is not limited to being located at the downstream side with respect to the downstream end 41*e* of the standby tray 41. FIG. 9 is a cross-sectional view illustrating main portions of a post-processing apparatus 103 according to a modification of the embodiment. As shown in FIG. 9, in the sheet conveyance direction V, a downstream end 150*e* of a processing tray 150 may be located at the upstream side with respect to the downstream end 41*e* of the standby tray 41. The downstream end part of a conveyance belt 154 is overlapped with the downstream end 150*e* of the processing tray 150 when viewed from the sheet width direction W. In the sheet conveyance direction V, the length of a processing section 122 of the present modification is shorter than that of the processing section 22 (refer to FIG. 2) of the embodiment. A distance between the outlet side conveyance section 33 and the side of the post-processing apparatus 103 in the sheet conveyance direction V is referred to as a "skip distance". The length of the skip distance of the present modification is shorter than that of the skip distance (refer to FIG. 2) of the embodiment.

Figure 10:
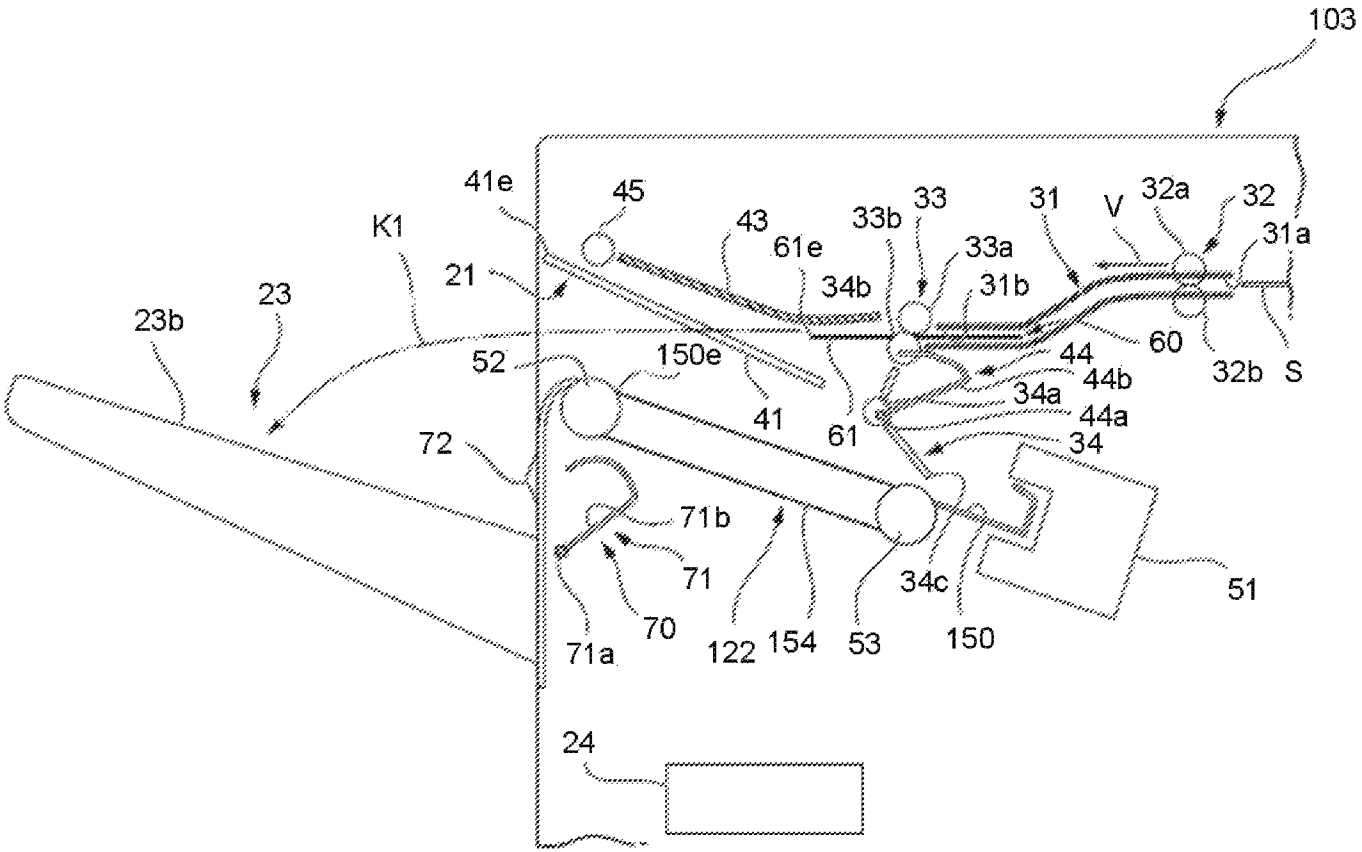
FIG. 10 is a view illustrating an example of operations of the post-processing apparatus according to the modification of the embodiment.

FIG. 10 is a view illustrating an example of operations of the post-processing apparatus 103 according to the modification of the embodiment. In FIG. 10, an arrow K1 indicates the skip route. As shown in FIG. 10, the skip route (arrow K1) of the present modification is shorter than that of the skip route (arrow K shown in FIG. 7) of the embodiment.

According to the present modification, compared with a case in which the downstream end of the processing tray 50 is arranged at the downstream side with respect to the downstream end of the standby tray 41 (refer to FIG. 7), the skip route can be shortened. Thus, at the time of skipping the standby tray 41 and the processing tray 150 to convey the sheet S towards the movable tray 23*b*, it becomes easy to discharge the sheet S towards the movable tray 23*b* more stably.

According to at least one embodiment described above, the post-processing apparatus 3 is equipped with the standby tray 41, the processing tray 50, the movable tray 23*b*, the lower supporting plate 61, the advance and retreat drive section 62 and the post-processing control section 24. The processing tray 50 is located at the lower part of the standby tray 41. The movable tray 23*b* is located at the downstream side with respect to the processing tray 50 in the sheet conveyance direction V. The lower supporting plate 61 can support the sheet S from the lower part. The advance and retreat drive section 62 drives the lower supporting plate 61. The post-processing control section 24 controls the advance and retreat drive section 62 to arrange the lower supporting plate 61 at the downstream side with respect to the conveyance starting point of the sheet S in the sheet conveyance direction V in a case of skipping the standby tray 41 and the processing tray 50 to convey the sheet S towards the movable tray 23*b*. According to the foregoing constitution, the following effects work. In a case of conveying the sheet S, the extra way until the discharge of the sheet S to the movable tray 23*b* is not required by skipping the standby tray 41 and the processing tray 50 to convey the sheet S towards the movable tray 23*b*. Thus, the processing speed of the post-processing apparatus 3 can be improved. In addition, the operations of the post-processing apparatus 3 are reduced since the sheet does not pass through the standby tray 41 and the processing tray 50. Thus, the noise can be suppressed and the power consumption can be reduced. In addition, in a case of skipping the standby tray 41 and the processing tray 50 to convey the sheet S towards the movable tray 23*b*, the following effects work by arranging the lower supporting plate 61 at the downstream side with respect to the conveyance starting point of the sheet S in the sheet conveyance direction V. At the time of skipping the standby tray 41 and the processing tray 50 to convey the sheet S towards the movable tray 23*b*, the lower surface of the sheet S can be guided by the lower supporting plate 61. Thus, it becomes easy to stably discharge the sheet S to the movable tray 23*b*.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming system, comprising:

a sheet accommodating unit configured to accommodate a plurality of sheets;

a printer unit configured to form an image on a sheet from the sheet accommodating unit;

a discharging unit configure to discharge the sheet having an image formed thereon;

a first tray configured to support a temporarily discharged sheet;

a second tray located at a lower part of the first tray configured to carry out a post-processing on sheets;

a third tray located at a downstream side with respect to the second tray in a sheet conveyance direction;

a sheet supporting plate configured to support the sheet;

a drive section configured to drive the sheet supporting plate; and a control device configured to control the drive section to arrange the sheet supporting plate at the downstream side with respect to a conveyance starting point of the sheet in the sheet conveyance direction in a case of skipping the first tray and the second tray to convey the sheet to the third tray.

2. The sheet processing apparatus according to claim 1, wherein the control device controls the drive section to arrange the sheet supporting plate at the downstream side with respect to the conveyance starting point of the sheet in the sheet conveyance direction in a non-processing mode.

3. The sheet processing apparatus according to claim 1, wherein the first tray is movable in order to avoid a skip route of the sheet.

4. The sheet processing apparatus according to claim 3, wherein the first tray comprises a first support member and a second support member capable of supporting the sheet from the lower part, wherein the first support member and the second support member are separatable from each other in a sheet width direction orthogonal to the sheet conveyance direction in order to avoid the skip route.

5. The sheet processing apparatus according to claim 1, wherein a downstream end part of the sheet supporting plate in the sheet conveyance direction is directed towards the third tray at the time of skipping the first tray and the second tray to convey the sheet towards the third tray.

6. The sheet processing apparatus according to claim 1, further comprising:

an upper part covering section configured to cover the sheet at the time of skipping the first tray and the second tray to convey the sheet towards the third tray.

7. The sheet processing apparatus according to claim 1, wherein a downstream end of the second tray is located at the upstream side with respect to a downstream end of the first tray in the sheet conveyance direction.

8. The sheet processing apparatus according to claim 1, further comprising:

a sheet height maintenance mechanism configured to maintain the height of an uppermost surface of the sheet conveyed to the third tray to a certain height.

9. The sheet processing apparatus according to claim 1, wherein the control device is configured to convey the sheet from an image forming apparatus directly to the third tray.

10. A sheet discharge method, comprising:

forming an image on a sheet;

discharging the sheet having an image formed thereon;

arranging a sheet supporting plate at a downstream side with respect to a conveyance starting point of the sheet in the sheet conveyance direction in a case of skipping a first tray and a second tray to convey the sheet to a third tray.

11. The sheet discharge method according to claim 10, wherein the sheet supporting plate is arranged at the downstream side with respect to the conveyance starting point of the sheet in the sheet conveyance direction in a non-processing mode.

12. The sheet discharge method according to claim 10, further comprising:

skipping a first tray and a second tray to convey the sheet to a third tray.

13. The sheet discharge method according to claim 10, further comprising:

moving a first tray in order to avoid a skip route of the sheet.

14. The sheet discharge method according to claim 13, further comprising:

supporting the sheet from a lower part; and separating a first support member and a second support member from each other in a sheet width direction orthogonal to the sheet conveyance direction in order to avoid the skip route.

15. The sheet discharge method according to claim 10, further comprising:

directing a downstream end part of the sheet supporting plate in the sheet conveyance direction towards the third tray at the time of skipping the first tray and the second tray to convey the sheet towards the third tray.

16. The sheet discharge method according to claim 10, further comprising:

covering the sheet from an upper part at the time of skipping the first tray and the second tray to convey the sheet towards the third tray.

17. The sheet discharge method according to claim 10, wherein a downstream end of the second tray is located at the upstream side with respect to a downstream end of the first tray in the sheet conveyance direction.

18. The sheet discharge method according to claim 10, further comprising:

maintaining a height of an uppermost surface of the sheet conveyed to a third tray to a certain height.

19. The sheet discharge method according to claim 10, further comprising:

conveying the sheet from an image forming apparatus directly to a third tray.

* * * * *